US009011585B2

(12) United States Patent
Muraki et al.

(10) Patent No.: US 9,011,585 B2
(45) Date of Patent: Apr. 21, 2015

(54) TREATMENT SOLUTION FOR INSULATION COATING FOR GRAIN-ORIENTED ELECTRICAL STEEL SHEETS

(71) Applicant: JFE Steel Corporation, Tokyo (JP)

(72) Inventors: Mineo Muraki, Tokyo (JP); Minoru Takashima, Tokyo (JP); Tomofumi Shigekuni, Tokyo (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 14/278,503

(22) Filed: May 15, 2014

(65) Prior Publication Data

US 2014/0245926 A1 Sep. 4, 2014

Related U.S. Application Data

(62) Division of application No. 12/671,972, filed as application No. PCT/JP2008/064075 on Jul. 30, 2008, now Pat. No. 8,771,795.

(30) Foreign Application Priority Data

Aug. 9, 2007 (JP) ..... 2007-207674

(51) Int. Cl.
*E04B 1/62* (2006.01)
*C21D 8/12* (2006.01)

(52) U.S. Cl.
CPC ..... *C21D 8/1288* (2013.01)

(58) Field of Classification Search
USPC ..... 106/14.05, 14.12; 252/62
See application file for complete search history.

(56) References Cited

U.S. PATENT DOCUMENTS

| | | | | |
|---|---|---|---|---|
| 3,856,568 | A | 12/1974 | Tanaka et al. | |
| 3,985,583 | A | 10/1976 | Shimanaka et al. | |
| 4,347,085 | A | 8/1982 | Haselkorn et al. | |
| 5,174,833 | A | 12/1992 | Tanaka et al. | |
| 5,743,971 | A * | 4/1998 | Inoue et al. | 148/247 |
| 6,096,140 | A * | 8/2000 | Susa et al. | 148/253 |
| 2006/0177685 | A1 | 8/2006 | Matsuda et al. | |
| 2008/0190520 | A1 * | 8/2008 | Watanabe et al. | 148/537 |
| 2010/0068396 | A1 * | 3/2010 | Kim et al. | 427/359 |

FOREIGN PATENT DOCUMENTS

| | | | |
|---|---|---|---|
| CN | 1048554 | A | 1/2000 |
| EP | 0 663 340 | A1 | 7/1995 |
| EP | 1 281 778 | A2 | 2/2003 |
| EP | 1 650 327 | A1 | 4/2006 |
| JP | 48-039338 | A | 6/1973 |
| JP | 50-079442 | A | 6/1975 |
| JP | 57-009631 | B1 | 2/1982 |
| JP | 58-044744 | B | 10/1983 |
| JP | 4-165022 | A | 6/1992 |
| JP | 2791812 | B2 | 8/1998 |
| JP | 11-310757 | A * | 11/1999 |
| JP | 2004-143532 | A | 5/2004 |
| JP | 2004-232040 | A | 8/2004 |
| JP | 2010-13692 | A * | 1/2010 |
| WO | 2006/051923 | A1 | 5/2006 |

* cited by examiner

*Primary Examiner* — Anthony J Green
(74) *Attorney, Agent, or Firm* — DLA Piper LLP (US)

(57) ABSTRACT

A treatment solution for an insulation coating of grain-oriented electrical steel sheets includes at least one selected from phosphates of Mg, Ca, Ba, Sr, Zn, Al and Mn; colloidal silica in a proportion of 0.5 to 10 mol in terms of $SiO_2$; and a water-soluble vanadium compound in a proportion of 0.1 to 2.0 mol in terms of V, relative to $PO_4$:1 mol in the phosphates.

6 Claims, 2 Drawing Sheets

TREATMENT SOLUTION FOR INSULATION COATING FOR GRAIN-ORIENTED ELECTRICAL STEEL SHEETS

CROSS REFERENCE TO RELATED APPLICATION

This application is a divisional application of U.S. Ser. No. 12/671,972 filed Mar. 25, 2010, now issued as U.S. Pat. No. 8,771,795 on Jul. 8, 2014, which is a 371 of PCT/JP2008/064075 filed Jul. 30, 2008, which claims priority to JP 2007-207674 filed Aug. 9, 2007.

TECHNICAL FIELD

This disclosure relates to a chromium-free treatment solution for insulation coating, the treatment solution being useful in obtaining a grain-oriented electrical steel sheet having an insulation coating with properties substantially equal to those obtained by the use of a treatment solution, for insulation coating, containing a chromium compound. The disclosure also relates to a method for producing a grain-oriented electrical steel sheet having an insulation coating using the chromium-free treatment solution.

BACKGROUND

In recent years, noises arising from transformers for electric power have become environmentally problematic. A primary cause of the noise of a transformer for electric power is the magnetostriction of a grain-oriented electrical steel sheet used in the core of the transformer. To reduce the transformer noise, the magnetostriction of the grain-oriented electrical steel sheet needs to be reduced. An industrially advantageous solution is to coat the grain-oriented electrical steel sheet with an insulation coating.

Properties required for insulation coatings for grain-oriented electrical steel sheets include tension induced by a coating, moisture-absorption resistance, rust resistance, and lamination factor. Among these properties, it is important to secure tension induced by a coating for the purpose of the reduction of magnetostriction. The term "tension induced by a coating" as used herein means tension imparted to a grain-oriented electrical steel sheet by the formation of an insulation coating.

A coating on a grain-oriented electrical steel sheet includes a ceramic forsterite sub-coating formed by secondary recrystallization annealing and a phosphate-based insulation sub-coating disposed thereon. Known techniques for forming such an insulation coating are those disclosed in Japanese Unexamined Patent Application Publication No. 48-39338 and Japanese Unexamined Patent Application Publication No. 50-79442. In these techniques, steel sheets are coated with treatment solutions for insulation coating each containing colloidal silica, a phosphate, and a chromium compound (for example, one or more selected from chromic anhydride, a chromate, and a bichromate) and then baked.

Insulation coatings formed by these techniques have an advantage that magnetostrictive properties thereof are improved by applying tensile stress to grain-oriented electrical steel sheets. These treatment solutions contain a chromium compound, such as chromic anhydride, a chromate, or a bichromate, serving as a component for maintaining the moisture-absorption resistance of the insulation coatings well and therefore contain hexavalent chromium derived from the chromium compound. Japanese Unexamined Patent Application Publication No. 50-79442 also discloses a technique using no chromium compound. However, such a technique is extremely disadvantageous in view of moisture-absorption resistance. Hexavalent chromium contained in the treatment solutions is reduced into trivalent chromium, which is harmless, by baking However, there is a problem in that various costs are incurred in treating the waste treatment solutions.

Japanese Examined Patent Application Publication No. 57-9631 discloses a treatment solution for insulation coating. The treatment solution is a so-called "chromium-free" treatment solution, for insulation coating for grain-oriented electrical steel sheets, containing substantially no chromium and contains colloidal silica, aluminum phosphate, boric acid, and one or more selected from sulfates of Mg, Al, Fe, Co, Ni, and Zn. Japanese Examined Patent Application Publication No. 58-44744 discloses a treatment solution, for insulation coating, containing colloidal silica, magnesium phosphate, boric acid, and one or more selected from sulfates of Mg, Al, Mn, and Zn. The use of the treatment solutions disclosed in Japanese Examined Patent Application Publication Nos. 57-9631 and 58-44744 is problematic in recent requirements for coating properties such as tension induced by a coating and moisture-absorption resistance.

Japanese Patent No. 2791812 discloses colloidal solutions (a particle size of 80 to 3000 nm) of oxides, carbides, nitrides, sulfides, borides, hydroxides, silicates, carbonates, borates, sulfates, nitrates, or chlorides containing Fe, Ca, Ba, Zn, Al, Ni, Sn, Cu, Cr, Cd, Nd, Mn, Mo, Si, Ti, W, Bi, Sr, and/or V. The colloidal solutions are used as additives for treatment solutions, for insulation coating, containing colloidal silica and a phosphate. These additives are used to improve the slippage (sticking resistance (removal property of stiction)) of and lubricity of insulation coatings such that troubles are avoided during the working of sheets into cores. The treatment solutions disclosed in Japanese Patent No. 2791812 need to contain a chromium compound. Japanese Patent No. 2791812 discloses no specific solutions or countermeasures to the above problems due to the use of chromium.

It could therefore be helpful:

- to prevent a reduction in tension induced by a coating and a reduction in moisture-absorption resistance which are issues involved in causing treatment solutions for insulation coating to be chromium-free;
- to provide a chromium-free treatment solution for insulation coating for grain-oriented electrical steel sheets, the chromium-free treatment solution being useful in achieving tension induced by a coating, moisture-absorption resistance, rust resistance, and lamination factor which are substantially equal to those obtained by the use of a chromium-containing treatment solution for insulation coating and which are properties required for insulation coatings for grain-oriented electrical steel sheets; and
- to provide a method for producing a grain-oriented electrical steel sheet having an insulation coating using the chromium-free treatment solution for insulation coating for grain-oriented electrical steel sheets.

SUMMARY

We endeavored to produce a grain-oriented electrical steel sheet having a desired tension induced by a coating and desired moisture-absorption resistance using a chromium-free treatment solution for insulation coating.

That is, we added various metal compounds to treatment solutions, for insulation coating, containing a phosphate and colloidal silica; coated grain-oriented electrical steel sheets subjected to secondary recrystallization annealing with the resulting treatment solutions; and then baked the resulting grain-oriented electrical steel sheets. We then investigated properties of the obtained coatings.

As a result, we found that the use of a water-soluble vanadium compound which is one of the metal compounds is effective.

We thus provide:

(1) A treatment solution for insulation coating for grain-oriented electrical steel sheets contains at least one selected from phosphates of Mg, Ca, Ba, Sr, Zn, Al, and Mn; colloidal silica in a proportion of 0.5 to 10 mol in terms of $SiO_2$ and a water-soluble vanadium compound in a proportion of 0.1 to 2.0 mol in terms of V, relative to $PO_4$:1 mol in the phosphates.

The treatment solution for insulation coating is preferably chromium-free and particularly preferably contains substantially no Cr. The treatment solution is preferably aqueous.

The water-soluble vanadium compound contains at least one selected from the group consisting of potassium vanadate, ammonium vanadate and vanadium bromide.

The water-soluble vanadium compound is at least one selected from the group consisting of potassium vanadate, ammonium vanadate and vanadium bromide.

The water-soluble vanadium compound is at least one selected from the group consisting of potassium vanadate, ammonium vanadate, and vanadium bromide in a proportion of 0.2 mol or more in terms of V, relative to $PO_4$:1 mol in the phosphates.

(2) A method for producing a grain-oriented electrical steel sheet having an insulation coating includes series of steps of rolling a slab for grain-oriented electrical steel sheets into a sheet with a final thickness, subjecting the sheet to primary recrystallization annealing, subjecting the sheet to secondary recrystallization annealing, coating the sheet with a treatment solution for insulation coating, and then baking the sheet. The treatment solution contains at least one selected from phosphates of Mg, Ca, Ba, Sr, Zn, Al, and Mn; colloidal silica in a proportion of 0.5 to 10 mol in terms of $SiO_2$ and a water-soluble vanadium compound in a proportion of 0.1 to 2.0 mol in terms of V, relative to $PO_4$:1 mol in the phosphates.

The treatment solution for insulation coating is preferably chromium-free and particularly preferably contains substantially no Cr. The treatment solution is preferably aqueous.

In the rolling, it is preferred that after hot rolling is performed, or normalizing annealing is further performed, cold rolling is performed once, or twice or more including intermediate annealing, and thereby final sheet thickness is obtained. It is preferred that after primary recrystallization annealing is performed, the application of an annealing separator containing MgO as a primary component is performed and secondary recrystallization annealing is then performed.

DETAILED DESCRIPTION

Figure 1:
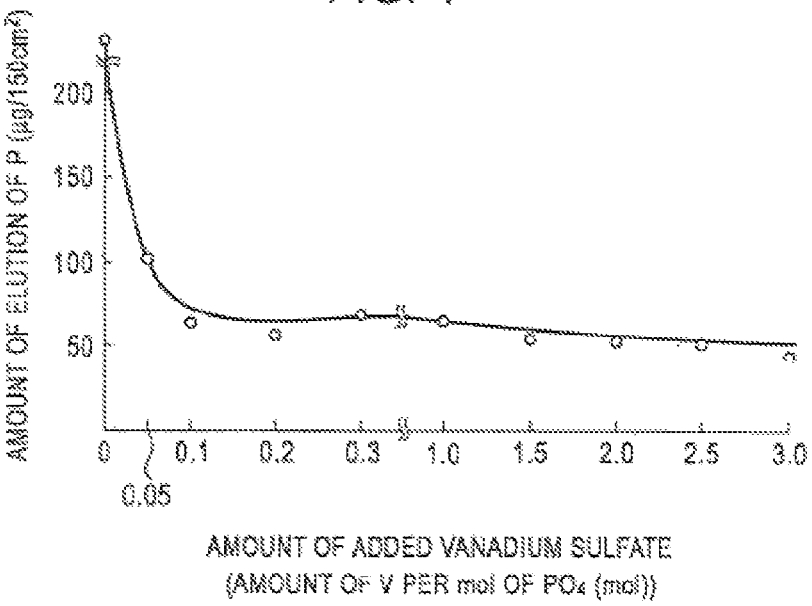
FIG. 1 is a graph showing the influence of the amount (the amount in moles of V per mole of $PO_4$ on the horizontal axis) of vanadium sulfate added to treatment solutions for insulation coating on the moisture-absorption resistance (the amount in μg of elution of P per 150 $cm^2$ on the vertical axis) of insulation coatings.

Experiment results are described below.

Treatment solutions for insulation coating were prepared by mixing the following compounds:

450 ml of a 24 mass percent aqueous solution of magnesium phosphate ($Mg(H_2PO_4)_2$) (1 mol of $PO_4$), 450 ml of 27 mass percent colloidal silica (aqueous) (2 mol of $SiO_2$), and various amounts of vanadium sulfate (0.05 to 3 mol of V).

Vanadium sulfate used was supplied in the form of a solid and was dissolved in the treatment solutions. The treatment solutions were prepared such that the above mixing ratios were maintained and the amounts of the treatment solutions were sufficient for experiments below.

Grain-oriented electrical steel sheets (a thickness of 0.20 mm), subjected to secondary recrystallization annealing, having forsterite coatings were each coated with a corresponding one of the treatment solutions and then baked at 800° C. for 60 seconds. Coatings formed by baking had a thickness of 2 μm (per single surface). The resulting grain-oriented electrical steel sheets were evaluated for tension induced by a coating, moisture-absorption resistance, and rust resistance by methods below.

Tension induced by a coating a: Each steel sheet was cut so as to have a width of 30 mm and a length of 280 mm in such a manner that the length direction of the steel sheet was set to the rolling direction of the steel sheet. An insulation coating was removed from one of the both faces of the steel sheet. The amount of curvature deformation of the steel sheet was measured in such a manner that a portion 30 mm spaced from an end of the steel sheet in the length direction thereof was retained. The tension induced by a coating a was determined from Equation (1) below. The amount of curvature deformation of the steel sheet was measured in such a manner that the length direction and width direction of the steel sheet were set to the horizontal direction and the vertical direction, respectively, for the purpose of eliminating the influence of the steel sheet's own weight.

$$\sigma\ (\text{MPa}) = 121520\ (\text{MPa}) \times \text{thickness}\ (\text{mm}) \times \text{amount of curvature deformation}\ (\text{mm})/250\ (\text{mm})/250\ (\text{mm}) \quad (1)$$

Moisture-absorption resistance: Three 50 mm×50 mm specimens were taken from each steel sheet. The specimens were dipped and boiled in 100° C. distilled water for five minutes. The amount of P dissolved from each coating was determined and obtained measurements were averaged into an index.

Rust resistance: After the steel sheets were left in air having a humidity of 50% and a dew point of 50° C. for 50 hours, the steel sheets were observed for appearance. A rating of A was given to those having no rust, a rating of B was given to those having dotted rust (rust spots spaced from each other), and a rating of C was given to those having areal rust (rust areas having a two dimensional spread and continuity). The area percentage of rust on one with a rating of A was less than about 5%, that of rust on one with a rating of B was about 5% to 10%, and that of rust on one with a rating of C was more than about 10%.

Figure 2:
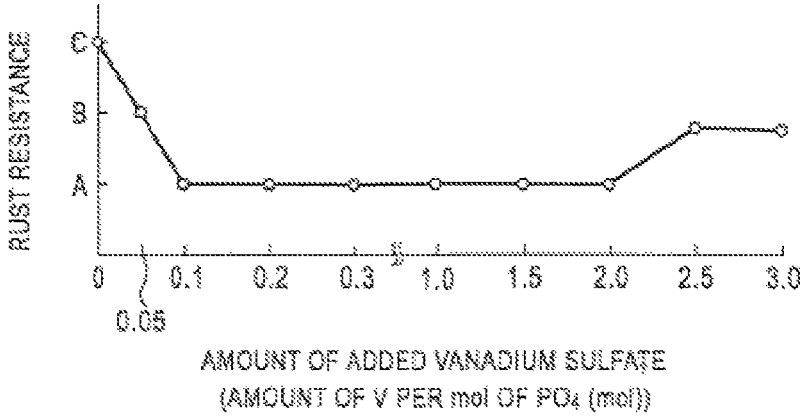
FIG. 2 is a graph showing the influence of the amount (the horizontal axis as well as that in FIG. 1) of vanadium sulfate added to treatment solutions for insulation coating on the rust resistance (three ratings of A to C on the vertical axis) of insulation coatings.
Figure 3:
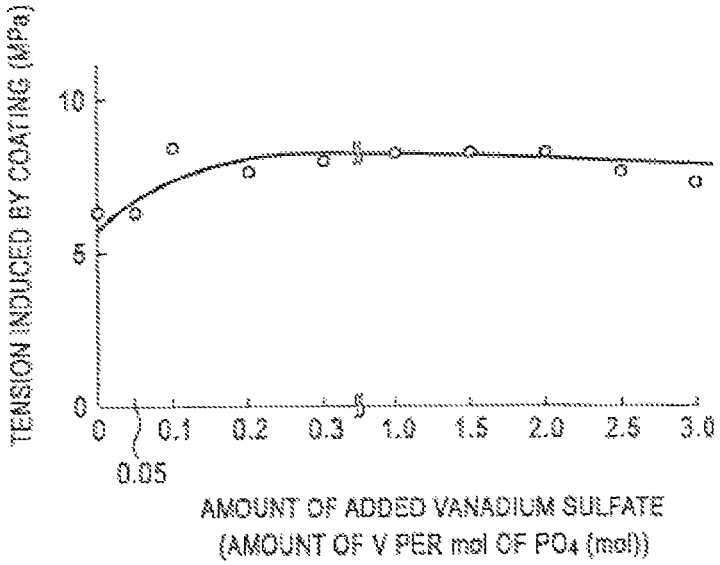
FIG. 3 is a graph showing the influence of the amount (the horizontal axis as well as that in FIG. 1) of vanadium sulfate added to treatment solutions for insulation coating on the tension (in MPa on the vertical axis) of insulation coatings.

The evaluation results are shown in FIGS. 1 to 3.

FIG. 1 shows the influence of the amount (the amount in moles of V per mole of $PO_4$ on the horizontal axis) of vanadium sulfate added to the treatment solutions on the moisture-absorption resistance (the amount in μg of elution of P per 150 $cm^2$ on the vertical axis) of insulation coatings. FIG. 2 shows the influence of the amount (the horizontal axis) of added vanadium sulfate on the rust resistance (three ratings of A to C on the vertical axis). FIG. 3 shows the influence of the amount (the horizontal axis) of added vanadium sulfate on the tension (in MPa on the vertical axis) induced by a coating. When the amount of added vanadium sulfate per mole of $PO_4$ is 0.1 mol or more, the moisture-absorption resistance and rust resistance are remarkably improved and the tension induced by a coating is slightly increased and is kept constant and high. When the amount thereof is more than 2 mol, the rust resistance is deteriorated and the tension induced by a coating is slightly reduced although the moisture-absorption resistance is not problematic.

Treatment Solution for Insulation Coating

The reason for selecting a treatment solution for insulation coating is described below.

The treatment solution is preferably aqueous. The treatment solution contains water preferably, which serves as a solvent; at least one selected from phosphates of Mg, Ca, Ba, Sr, Zn, Al, and Mn; colloidal silica; and a water-soluble vanadium compound.

The treatment solution contains one or more selected from the phosphates of Mg, Ca, Ba, Sr, Zn, Al, and Mn. This is because no coating with good moisture-absorption resistance can be obtained from a phosphate other than these phosphates in the case of not adding a chromium compound (for example, chromic anhydride) to the treatment solution. In particular, the following phosphates are readily soluble in water and therefore are preferred: $Mg(H_2PO_4)_2$, $Ca(H_2PO_4)_2$, $Ba(H_2PO_4)_2$, $Sr(H_2PO_4)_2$, $Zn(H_2PO_4)_2$, $Al(H_2PO_4)_3$, and $Mn(H_2PO_4)_2$, which are monomagnesium phosphate, monocalcium phosphate, monobarium phosphate, monstrontium phosphate, monozinc phosphate, monoaluminum phosphate, and monomanganese phosphate, respectively. Hydrates of these phosphates are also preferred.

Colloidal silica is mixed with the phosphate such that the amount of $SiO_2$ per mole of $PO_4$ in the phosphate is 0.5 to 10 mol. Colloidal silica is an essential substance because colloidal silica reacts with the phosphate to produce a compound with a small expansion coefficient to create tension induced by a coating. To achieve the above advantage, the amount of $SiO_2$ per mole of $PO_4$ in the phosphate is preferably 0.5 mol or more and 10 mol or less.

The type of colloidal silica used is not particularly limited as long as the stability of the treatment solution and the compatibility with the phosphate are secured. An example of colloidal silica used is ST-O (produced by Nissan Chemical Industries, Ltd., a $SiO_2$ content of 20 mass percent), which is an acid type of commercially available colloidal silica. An alkali type of colloidal silica can be used herein.

Colloidal silica containing aluminum (Al)-containing sol can be used herein to improve the appearance of an insulation coating. The amount of Al used is preferably determined such that the ratio of $Al_2O_3$ to $SiO_2$ is one or less.

To improve the moisture-absorption resistance of the insulation coating, it is particularly important to mix the water-soluble vanadium compound with the phosphate such that the amount of V per mole of $PO_4$ in the phosphate is 0.1 to 2.0 mol.

Examples of advantageous water-soluble vanadium compound include vanadium sulfate, vanadium chloride, vanadium bromide, potassium vanadate, sodium vanadate, ammonium vanadate, and lithium vanadate. Hydrates of these compounds can be used herein. In particular, the treatment solution preferably contains vanadium sulfate or ammonium vanadate and may further contain another water-soluble vanadium compound as required.

To achieve good moisture-absorption resistance, the treatment solution needs to contain 0.1 mol or more of V, in the form of the water-soluble vanadium compound, per mole of $PO_4$ in the phosphate. When the amount of V per mole of $PO_4$ in the phosphate is more than 2.0 mol, the deterioration of rust resistance is caused. This is believed to be due to microcracks in the insulation coating. The amount of V in the water-soluble vanadium compound mixed with the phosphate is preferably 1.0 to 2.0 mol.

The concentration of the above primary components in the treatment solution need not be particularly limited. When the concentration thereof is low, the insulation coating has a small thickness. When the concentration thereof is low, the treatment solution has high viscosity and therefore has low coating workability. In consideration of these facts, the concentration of the phosphate therein is preferably within a range from about 0.02 to 20 mol/litter. The concentration of colloidal silica and that of the water-soluble vanadium compound therein are determined depending on the concentration of the phosphate.

The treatment solution may further contain substances below in addition to the above primary components.

The treatment solution may contain boric acid such that the insulation coating has increased heat resistance.

The treatment solution may contain one or more selected from $SiO_2$, $Al_2O_3$, and $TiO_2$ with a primary particle size of 50 to 2000 nm such that a grain-oriented electrical steel sheet has increased removal property of stiction and/or increased slippage. The reason for requiring removal property of stiction is as described below. In the case of using the grain-oriented electrical steel sheet for wound-core transformers, the steel sheet is wound into cores, which are then subjected to stress relief annealing (at, for example, about 800° C. for about three hours). In this operation, the fusion of adjacent coatings can occur. The fusion thereof causes a reduction in the interlayer insulation resistance of the cores, resulting in the deterioration of magnetic properties thereof. Therefore, removal property of stiction is preferably imparted to the insulation coating. In the case of using the grain-oriented electrical steel sheet for stacked-core transformers, the slippage between pieces of the steel sheet is preferably good to smoothly stack the pieces.

The treatment solution may contain various additives that may be used for treatment solution for insulation coating other than the above substances. The total content of boric acid, the additives, and one or more selected from $SiO_2$, $Al_2O_3$, and $TiO_2$ is preferably about 30 mass percent or less.

The treatment solution is preferably chromium-free and particularly preferably contains substantially no Cr. The term "containing substantially no Cr" means that Cr derived from impurities contained in raw materials is acceptable and Cr is not intentionally added to the treatment solution. Most of the above components, that is, the phosphate, colloidal silica, the vanadium compound, and the like are commercially available. The trace amount of Cr, which is contained in these commercially available compounds, is acceptable.

The reason why the treatment solutions disclosed in Japanese Patent No. 2791812 containing the chromium compound contains a vanadium compound is to enhance the productivity of cores as well as $SiO_2$, $Al_2O_3$, and $TiO_2$ in the chromium-free treatment solution for insulation coating. On the other hand, the reason why the treatment solution contains the vanadium compound is to enhance coating properties of the chromium-free insulation coating. The purpose of containing vanadium compound is significantly different from the purpose disclosed in Japanese Patent No. 2791812.

Furthermore, the vanadium compound contained in the treatment solutions disclosed in Japanese Patent No. 2791812 is colloidal. However, the vanadium compound contained in our treatment solution is water-soluble. The water-soluble vanadium compound is significantly different from the colloidal vanadium compound in that phosphates of Mg, Ca, Ba, Sr, Zn, Al, and Mn are improved in moisture-absorption resistance at the point of time when the water-soluble vanadium compound is mixed with the phosphates.

Method for Producing Grain-Oriented Electrical Steel Sheet

A method for producing a grain-oriented electrical steel sheet using the chromium-free treatment solution will now be described.

A slab for grain-oriented electrical steel sheets is rolled into a sheet with a final thickness and the sheet is subjected to primary recrystallization annealing, subjected to secondary recrystallization annealing, coated with the treatment solution, and then baked. Typically, the slab is hot-rolled into a hot-rolled sheet and the hot-rolled sheet is annealed as required and then cold-rolled into a cold-rolled sheet with a final thickness.

The composition of the grain-oriented electrical steel sheet is not particularly limited and the grain-oriented electrical steel sheet may have any known composition. The method is not particularly limited and may be any known one. The grain-oriented electrical steel sheet typically contains 0.10 mass percent or less C, 2.0 to 4.5 mass percent Si, and 0.01 to 1.0 mass percent Mn and preferably 0.08 mass percent or less C, 2.0 to 3.5 mass percent Si, and 0.03 to 0.3 mass percent Mn. Various inhibitors are usually used for the grain-oriented electrical steel sheet and therefore the steel contains elements corresponding to the inhibitors in addition to the above components.

When MnS is used as an inhibitor, the steel may contain about 200 ppm (that is, about 100 to 300 ppm, ppm hereinafter means mass ppm) S.

When AlN is used as an inhibitor, the steel may contain about 200 ppm (that is, about 100 to 300 ppm) sol. Al.

When MnSe and Sb are used as inhibitors, the steel may contain Mn, Se (about 100 to 300 ppm), and Sb (about 0.01 to 0.2 mass percent).

The content of each of S, Al, N, and Se in the steel sheet is reduced to an impurity level because most of S, Al, N, and Se are usually removed from the steel sheet during secondary recrystallization annealing.

The slab is usually hot-rolled. The hot-rolled sheet preferably has a thickness of about 1.5 to 3.0 mm. The hot-rolled sheet may be annealed for the purpose of further improving magnetic properties thereof.

The hot-rolled sheet or the annealed hot-rolled sheet is cold-rolled into a cold-rolled sheet with a final thickness. Cold rolling may be performed once, or twice or more with intermediate annealing performed between cold rollings.

The cold-rolled sheet with a final thickness is subjected to primary recrystallization annealing and then secondary recrystallization annealing (final annealing). The resulting cold-rolled sheet is coated with the treatment solution and then baked.

Primary recrystallization annealing can be performed together with decarburization by controlling an atmosphere and the like. Conditions of primary recrystallization annealing can be set depending on purposes. The cold-rolled sheet is preferably continuously treated at a temperature of 800° C. to 950° C. for ten to 600 seconds during primary recrystallization annealing. The cold-rolled sheet may be subjected to nitriding treatment using gaseous ammonia or the like during or after primary recrystallization annealing.

Secondary recrystallization annealing is an operation of preferentially growing crystal grains (primary recrystallized grains), formed during primary recrystallization annealing, in an orientation in which magnetic properties are superior in the rolling direction, that is, the so-called "Goss orientation." Conditions of secondary recrystallization annealing can be set depending on purposes or the like and preferably include a temperature of 800° C. to 1250° C. and a time of five to 600 hours.

Typically, after the cold-rolled sheet is subjected to primary recrystallization annealing, the cold-rolled sheet is coated with an annealing separator containing MgO as a primary component (that is, containing a sufficient amount of MgO) and then subjected to secondary recrystallization annealing, whereby a forsterite coating is formed on the steel sheet.

In recent years, it has been attempted to subject steel sheets having no forsterite coating to insulation coating treatment for the purpose of improving the core loss of grain-oriented electrical steel sheets. In the case of forming no forsterite coating, steel sheets are not coated with such an annealing separator or are coated with an annealing separator (for example, an aluminum-based annealing separator) in which MgO is not a primary component.

The chromium-free treatment solution for insulation coating can be used with or without a forsterite coating.

The secondarily recrystallized grain-oriented electrical steel sheet, which has been produced through the above steps, is coated with the chromium-free treatment solution for insulation coating and then baked.

The chromium-free treatment solution may be adjusted in density in such a manner that the chromium-free treatment solution is diluted with water for an improvement of applicability. A known tool such as a roll coater can be used to coat the steel sheet with the treatment solution.

The baking temperature of the steel sheet is preferably 750° C. or higher. This is because tension induced by a coating is generated by baking the steel sheet at 750° C. or higher. In the case of using the grain-oriented electrical steel sheet for transformer cores, the baking temperature thereof may be 350° C. or higher. This is because steel sheets are usually subjected to stress relief annealing at about 800° C. for about three hours for the production of transformer cores and tension induced by a coating is generated during stress relief annealing. Therefore, the lower limit of the baking temperature thereof is preferably 350° C.

The upper limit of the baking temperature thereof is preferably 1100° C.

The thickness of the insulation coating is not particularly limited and is preferably about 1 to 5 μm. When the thickness of the insulation coating is less than 1 μm, the tension induced by the insulation coating can be insufficient for some purposes because the tension induced thereby is proportional to the thickness of the insulation coating. When the thickness thereof is more than 5 μm, the lamination factor thereof may be unnecessarily low. The thickness of the insulation coating can be adjusted to a target value by controlling the concentration of the treatment solution, the coating amount thereof, coating conditions (for example, conditions for pressing a roll coater), and/or the like.

EXAMPLES

Example 1

The following slabs were prepared: slabs, for grain-oriented electrical steel sheets, containing 0.06 mass percent C, 3.4 mass percent Si, 0.03 mass percent sol. Al, 0.06 mass percent Mn, and 0.02 mass percent Se, the remainder being Fe and unavoidable impurities. Each slab was hot-rolled into a hot-rolled sheet with a thickness of 2.3 mm. The hot-rolled sheet was annealed at 1050° C. for 60 seconds. The resulting hot-rolled sheet was primarily cold-rolled so as to have a thickness of 1.4 mm, subjected to intermediate annealing at 1100° C. for 60 seconds, and then secondarily cold-rolled into a cold-rolled sheet with a final thickness of 0.20 mm. The cold-rolled sheet was subjected to primary recrystallization annealing and decarburization at 820° C. for 150 seconds. The resulting cold-rolled sheet was coated with MgO slurry serving as an annealing separator and then subjected to secondary recrystallization annealing at 1200° C. for 12 hours, whereby a grain-oriented electrical steel sheet having a forsterite coating was obtained.

Each of vanadium compounds shown in Table 1 was mixed with 500 ml of an aqueous solution containing 1 mol of $PO_4$ in the form of magnesium phosphate ($Mg(H_2PO_4)_2$) and 700 ml of colloidal silica (aqueous) containing 3 mol of $SiO_2$, whereby a chromium-free treatment solution for insulation coating was prepared. The amount of the treatment solution was set to be sufficient for experiments below with the above mixing ratio maintained. The same applies to cases below. The grain-oriented electrical steel sheets subjected to secondary recrystallization annealing were each coated with a corresponding one of the treatment solutions and then baked at 850° C. for one minute.

In comparative examples, grain-oriented electrical steel sheets having insulation coatings were each produced in the same way using a corresponding one of a chromium-free treatment solution for insulation coating containing no vanadium compound, a treatment solution for insulation coating containing 1 mol of magnesium sulfate heptahydrate (in terms of Mg) instead of the vanadium compound, and a chromium-free treatment solution for insulation coating containing 30 ml of colloidal $V_2O_3$ (an average particle size of 1000 nm) containing 0.2 mol of V.

In a conventional example using a treatment solution for insulation coating containing a chromium compound, a treatment solution for insulation coating was prepared in such a manner that 0.1 mol of Cr in the form of potassium bichromate was mixed with 500 ml of an aqueous solution containing 1 mol of $PO_4$ in the form of magnesium phosphate ($Mg(H_2PO_4)_2$) and 700 ml of colloidal silica (aqueous) containing 3 mol of $SiO_2$. A grain-oriented electrical steel sheet having an insulation coating was produced using this treatment solution.

The obtained grain-oriented electrical steel sheets having the insulation coatings were evaluated for tension induced by a coating, moisture-absorption resistance, rust resistance, and lamination factor by methods below. The insulation coatings each had a thickness of 2 μm (per single surface).

Tension induced by a coating σ: Each steel sheet was cut so as to have a width of 30 mm and a length of 280 mm in such a manner that the length direction of the steel sheet was set to the rolling direction of the steel sheet. An insulation coating was removed from one of the both faces of the steel sheet. The amount of curvature deformation of the steel sheet was measured in such a manner that a portion 30 mm spaced from an end of the steel sheet in the thickness direction thereof was retained. The tension induced by a coating σ was determined from Equation (1) below. The amount of curvature deformation of the steel sheet was measured in such a manner that the length direction and width direction of the steel sheet were set to the horizontal direction and the vertical direction, respectively.

$$\sigma\ (\text{MPa}) = 121520\ (\text{MPa}) \times \text{thickness}\ (\text{mm}) \times \text{amount of curvature deformation}\ (\text{mm})/250\ (\text{mm})/250\ (\text{mm}) \quad (1)$$

The target tension σ of a steel sheet induced by a coating is 8 MPa or more. The tension σ thereof depends on the thickness of the containing Therefore, the coatings having the same thickness were compared to each other.

Moisture-absorption resistance: Three 50 mm×50 mm specimens were taken from each steel sheet. The specimens were dipped and boiled in 100° C. distilled water for five minutes. The amount of P dissolved from each coating was determined and obtained measurements were averaged into an index. The target amount of elution of P is 80 μg/150 $cm^2$ or less.

Rust resistance: After the steel sheets were held in air having a humidity of 50% and a dew point of 50° C. for 50 hours, the steel sheets were observed for appearance. A rating of A was given to those having no rust, a rating of B was given to those having slight rust (dotted rust), and a rating of C was given to those having serious rust (areal rust).

Lamination factor: A method according to JIS C 2550 was used for evaluation.

The evaluation results are shown in Table 1.

TABLE 1

| No. | Vanadium compounds: Species | Vanadium compounds: Amount (in terms of V in moles)*1 | Others: Species | Others: Amount*1 | Tension induced by coating (MPa) | Moisture-absorption resistance*2 (μg/150 cm²) | Rust resistance*3 | Lamination factor (%) | Remarks | |
|---|---|---|---|---|---|---|---|---|---|---|
| 1 | Vanadium sulfate | 1.2 | — | — | 8.4 | 51 | A | 97.3 | Example 1 | chromium-free |
| 2 | Vanadium chloride | 1.0 | — | — | 8.4 | 53 | A | 97.5 | Example 2 | |
| 3 | Vanadium bromide | 1.5 | — | — | 8.8 | 58 | A | 97.2 | Example 3 | |
| 4 | Potassium vanadate | 0.2 | — | — | 9.8 | 60 | A | 97.3 | Example 4 | |
| 5 | Sodium vanadate | 0.1 | — | — | 8.2 | 60 | A | 97.2 | Example 5 | |
| 6 | Ammonium vanadate | 0.5 | — | — | 9.8 | 48 | A | 97.4 | Example 6 | |
| 7 | Lithium vanadate | 0.2 | — | — | 8.6 | 62 | A | 97.7 | Example 7 | |
| 8 | Vanadium sulfate, vanadium chloride | 0.8<br>0.4 | — | — | 8.7 | 59 | A | 97.4 | Example 8 | |
| 9 | Vanadium sulfate | 1.2 | Boric acid, $Al_2O_3$ | 0.1 mol<br>0.3 mol | 8.6 | 49 | A | 97.5 | Example 9 | |
| 10 | Vanadium sulfate | 0.05 | — | — | 6.2 | 101 | B | 97.2 | Comparative Example 1 | |
| 11 | Vanadium sulfate | 2.5 | — | — | 8.1 | 52 | B | 97.4 | Comparative Example 2 | |
| 12 | — | — | — | — | 7.9 | 1300 | C | 97.4 | Comparative Example 3 | |
| 13 | — | — | Magnesium sulfate heptahydrate | 1.0 mol | 6.7 | 98 | A | 97.1 | Comparative Example 4 | |
| 14 | $V_2O_5$ (colloid) | 0.2 | — | — | 8.9 | 220 | C | 97.2 | Comparative Example 5 | |
| 15 | — | — | Potassium bichromate | 0.1 mol | 9.1 | 48 | A | 97.4 | Conventional Example | Cr contained |

*1The number of moles of an element per mole of $PO_4$ (the element is V in the case of using a V compound, M in the case of using magnesium sulfate heptahydrate, or Cr in the case of using potassium bichromate).
*2Evaluation based on the amount of elution of P.
*3Evaluation using three ratings (A, B, and C in descending order).

As shown in this table, the use of the chromium-free treatment solutions containing 0.1 to 2.0 mol of V in the form of the water-soluble vanadium compounds remarkably improved tension induced by a coating and moisture-absorption resistance which are issues for conventional chromium-free treatment solutions for insulation coating and provided properties comparable to those obtained by the use of chromium-containing treatment solutions for insulation coating. Furthermore, rust resistance and lamination factor were good.

Comparative Example 5 is inferior in rust resistance to the inventive examples. This is probably because a colloidal vanadium compound is used in Comparative Example 5.

Example 2

The following slabs were prepared: slabs, for grain-oriented electrical steel sheets, containing 0.03 mass percent C, 3 mass percent Si, less than 0.01 mass percent sol. Al, 0.04 mass percent Mn, less than 0.01 mass percent S, 0.02 mass percent Se, and 0.03 mass percent Sb, the remainder being Fe and unavoidable impurities. Each slab was hot-rolled into a hot-rolled sheet with a thickness of 1.8 mm. The hot-rolled sheet was annealed at 1050° C. for 60 seconds. The resulting hot-rolled sheet was cold rolled once, whereby a cold-rolled sheet with a final thickness of 0.40 mm was obtained. The cold-rolled sheet was subjected to primary recrystallization annealing at 850° C. for 600 seconds. The resulting cold-rolled sheet was coated with MgO slurry serving as an annealing separator and then subjected to secondary recrystallization annealing at 880° C. for 50 hours, whereby a grain-oriented electrical steel sheet having a forsterite coating was obtained.

The following solutions were prepared: aqueous solutions containing 1 mol of $PO_4$ in the form of various phosphates shown in Table 2 (No. 9 containing 0.5 mol of each of a plurality of phosphates, that is, 1 mol of the phosphates in total). Each of chromium-free treatment solutions for insulation coating was prepared in such a manner that 500 ml of a corresponding one of the aqueous solutions was mixed with 700 ml of colloidal silica (aqueous) containing an amount of $SiO_2$ as shown in Table 2 and 0.7 mol of V in the form of vanadium sulfate.

The grain-oriented electrical steel sheets were each coated with a corresponding one of the treatment solutions and then baked at 800° C. for 60 seconds. Coatings formed by baking was controlled to have a thickness of 3 μm per single surface.

The baked grain-oriented electrical steel sheets were evaluated for tension induced by a coating, moisture-absorption resistance, rust resistance, and lamination factor by the methods as those described in Example 1.

The evaluation results are shown in Table 2.

TABLE 2

| No. | Phosphates Species | Phosphates Formula | Content of colloidal silica (in terms of $SiO_2$ in moles)*1 | Tension induced by coating (MPa) | Moisture-absorption resistance*2 (μg/150 $cm^2$) | Rust resistance*3 | Lamination factor (%) | Remarks |
|---|---|---|---|---|---|---|---|---|
| 1 | Monomagnesium phosphate dihydrate | $Mg(H_2PO_4)_2$ $2H_2O$ | 2 | 13.2 | 62 | A | 98.1 | Example |
| 2 | Monomagnesium phosphate | $Mg(H_2PO_4)_2$ | 6 | 14.0 | 55 | A | 97.9 | Example |
| 3 | Monocalcium phosphate | $Ca(H_2PO_4)_2$ | 0.8 | 12.7 | 48 | A | 98.0 | Example |
| 4 | Monoaluminum phosphate | $Al(H_2PO_4)_3$ | 3 | 13.4 | 71 | A | 98.0 | Example |
| 5 | Monobarium phosphate | $Ba(H_2PO_4)_2$ | 0.8 | 13.1 | 70 | A | 98.3 | Example |
| 6 | Monostrontium phosphate | $Sr(H_2PO_4)_2$ | 0.8 | 12.6 | 45 | A | 98.2 | Example |
| 7 | Monozinc phosphate | $Zn(H_2PO_4)_2$ | 3 | 13.5 | 49 | A | 97.7 | Example |
| 8 | Monomanganese phosphate | $Mn(H_2PO_4)_3$ | 7 | 14.2 | 54 | A | 97.3 | Example |
| 9 | Monomagnesium phosphate dihydrate, monoaluminum phosphate | $Mg(H_2PO_4)_2$ $2H_2O$, $Al(H_2PO_4)_2$ | 0.5 | 12.3 | 50 | A | 97.8 | Example |

*1The number of moles of $SiO_2$ per mole of $PO_4$.
*2Evaluation based on the amount of elution of P.
*3Evaluation using three ratings (A, B, and C in descending order).

As shown in this table, excellent properties such as tension induced by a coating, moisture-absorption resistance, rust resistance, and lamination factor were achieved by the use of the treatment solutions containing the phosphates specified in the disclosure and an appropriate amount of colloidal silica.

Industrial Applicability

An insulation coating having excellent tension induced by a coating, moisture-absorption resistance, rust resistance, and lamination factor together can be formed on a grain-oriented electrical steel sheet. This allows the magnetostriction of the grain-oriented electrical steel sheet to be reduced, leading to a reduction in noise.

A chromium-free treatment solution for insulation coating is useful in producing a grain-oriented electrical steel sheet without causing any waste liquid containing a harmful chromium compound. The grain-oriented electrical steel sheet has an insulation coating with excellent coating properties comparable to those obtained by the use of a treatment solution, for insulation coating, containing a chromium compound.

The invention claimed is:

1. A treatment solution for an insulation coating of grain-oriented electrical steel sheets, comprising:

at least one selected from the group consisting of phosphates of Mg, Ca, Ba, Sr, Zn, Al, and Mn;

colloidal siliva in a proportion of 0.5 to 10 mol in terms of $SiO_2$; and a water-soluble vanadium compound in a proportion of 0.1 to 2.0 mol in terms of V, relative to 1 $PO_4$ mol in the phosphates, wherein the water-soluble vanadium compound contains at least one select from the group consisting of potassium vanadate, ammonium vanadate and vanadium bromide.

2. The treatment solution according to claim 1, containing substantially no Cr.

3. A treatment solution for an insulation coating of grain-oriented electrical steel sheets, comprising:

at least one selected from the group consisting of phosphates of Mg, Ca, Ba, Sr, Zn, Al, and Mn;

colloidal silica in a proportion of 0.5 to 10 mol in terms of $SiO_2$; and a water-soluble vanadium compound in a proportion of 0.1 to 2.0 mol in terms of V, relative to $PO_4$:1 mol in the phosphates, wherein the water-soluble vanadium compound is at least one selected from the group consisting of potassium vanadate, ammonium vanadate and vanadium bromide.

4. The treatment solution according to claim 3, containing substantially no Cr.

5. A treatment solution for an insulation coating of grain-oriented electrical steel sheets, comprising:

at least one selected from the group consisting of phosphates of Mg, Ca, Ba, Sr, Zn, Al, and Mn;

colloidal silica in a proportion of 0.5 to 10 mol in terms of $SiO_2$; and a water-soluble vanadium compound in a proportion of 0.1 to 2.0 mol in terms of V, relative to $PO_4$:1 mol in the phosphates, wherein the water-soluble vanadium compound is at least one selected from the group consisting of potassium vanadate, ammonium vanadate, and vanadium bromide in a proportion of 0.2 mol or more in terms of V, relative to $PO_4$:1 mol in the phosphates.

6. The treatment solution according to claim 5, containing substantially no Cr.

* * * * *

UNITED STATES PATENT AND TRADEMARK OFFICE

CERTIFICATE OF CORRECTION

PATENT NO. : 9,011,585 B2
APPLICATION NO. : 14/278503
DATED : April 21, 2015
INVENTOR(S) : Muraki et al.

It is certified that error appears in the above-identified patent and that said Letters Patent is hereby corrected as shown below:

In the Specification

In Column 4

At lines 35 and 43, please change "coating a" to -- coating σ --.

Signed and Sealed this
Twenty-seventh Day of October, 2015

Michelle K. Lee

Michelle K. Lee
*Director of the United States Patent and Trademark Office*